United States Patent [19]

Burkdoll et al.

[11] Patent Number: 4,688,466

[45] Date of Patent: Aug. 25, 1987

[54] EXPLOSIVE INITIATOR AND METHOD

[75] Inventors: Frank B. Burkdoll, Vacaville; Harold W. Hannagan, Napa, both of Calif.

[73] Assignee: Explosive Technology, Inc., Fairfield, Calif.

[21] Appl. No.: 906,491

[22] Filed: Sep. 11, 1986

[51] Int. Cl.[4] ..... F42C 15/20

[52] U.S. Cl. ..... 89/1.14; 102/261; 102/272

[58] Field of Search ..... 89/1.14; 102/204, 486–488, 102/275.11, 275.12, 272, 274, 260, 261

[56] References Cited

U.S. PATENT DOCUMENTS

| | | | |
|---|---|---|---|
| 760,820 | 5/1904 | Suppnick | 102/261 |
| 2,935,949 | 5/1960 | Holford | 102/261 |
| 3,386,334 | 6/1968 | Temple et al. | 89/1.14 |
| 3,619,927 | 11/1961 | Robinet | 89/1.14 X |
| 3,640,012 | 2/1972 | Schermuly | 89/1.14 X |
| 3,657,958 | 4/1972 | Wells | 102/261 X |
| 3,685,451 | 8/1972 | Bowring | 102/261 |
| 3,736,877 | 6/1973 | Roberts et al. | 102/261 X |
| 3,742,855 | 7/1973 | Webb | 102/261 X |
| 4,038,924 | 8/1977 | Beermann et al. | 89/1.14 X |
| 4,338,861 | 7/1982 | Rhodes et al. | 89/1.14 X |

*Primary Examiner*—David H. Brown

*Attorney, Agent, or Firm*—Flehr, Hohbach, Test, Albritton & Herbert

[57] ABSTRACT

Device and method for initiating an explosive charge, for example in an aircraft canopy jettisoning system. The initiator has an operating handle which is swung from a safe position to an armed position and then pushed to move a slide and actuate a firing mechanism. The device has a low profile and can be used in applications where space is limited.

15 Claims, 4 Drawing Figures

EXPLOSIVE INITIATOR AND METHOD

This invention pertains generally to explosive devices, and more particularly to a device and method for initiating an explosive reaction.

The controlled detonation of explosives is employed in aircraft and other applications to facilitate the escape of crew members and others in the event of an emergency. In aircraft, for example, explosive charges are employed in forming emergency egress openings, jettisoning canopies and ejecting seats and their occupants from the aircraft. The firing of such a charge is commonly initiated by a manually operated actuator having a primer charge connected to the explosive charge by an explosive transfer line. One embodiment of such an actuator is found in U.S. Pat. No. 3,657,958, and an example of an explosive transfer line suitable for use in such applications is found in U.S. Pat. No. 3,590,739.

It is generally desirable that the actuator be conveniently positioned and easy to operate, yet safe in the sense that the explosive charge will not be initiated accidentally. In many aircraft applications, space is limited, and it is difficult to fit an actuator which is large enough to be easily operated into the available space.

It is in general an object of the invention to provide a new and improved method for initiating an explosive reaction.

Another object of the invention is to provide an initiator and method of the above character in which the initiator is compact and can be employed in applications where space is limited.

Another object of the invention is to provide an initiator and method of the above character which are safe and easy to operate.

These and other objects are achieved in accordance with the invention by providing an initiator having a slide mounted on a body for movement in a longitudinal direction between a rest position and a firing position, firing means connected to the slide for initiating a charge when the slide is in the firing position, and a handle pivotally connected to the slide for movement between a safe position in which the handle holds the slide in the rest position and an armed position in which the handle extends in a transverse direction and can be pushed in the longitudinal direction to move the slide to the firing position. In the safe position, the handle is close to the body, and the initiator has a relatively low profile, making it particularly suitable for use in areas where space is limited.

Figure 1:
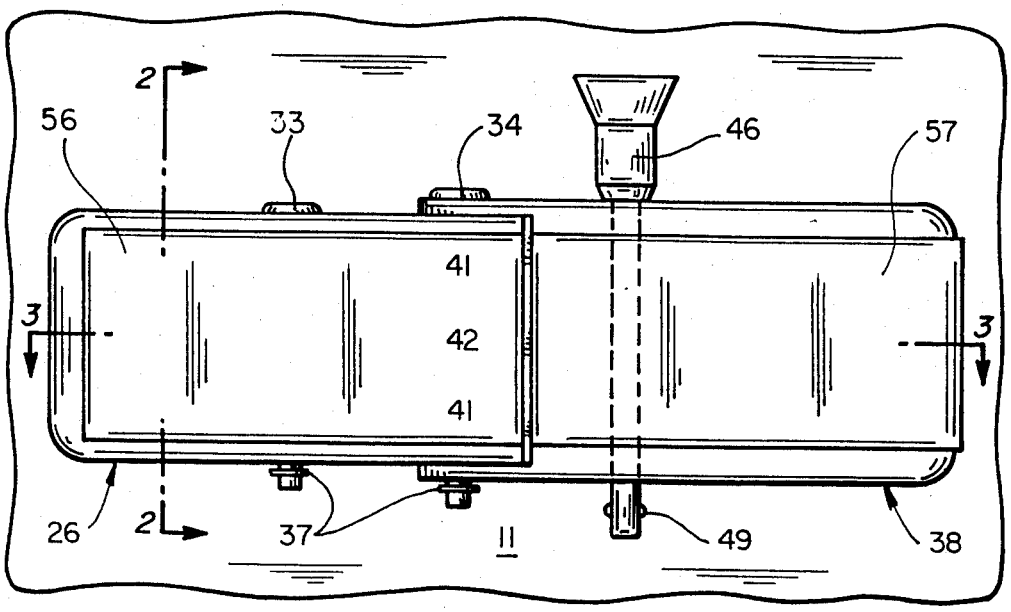
FIG. 1 is a front elevational view of one embodiment of an explosive initiator according to the invention.
Figure 2:
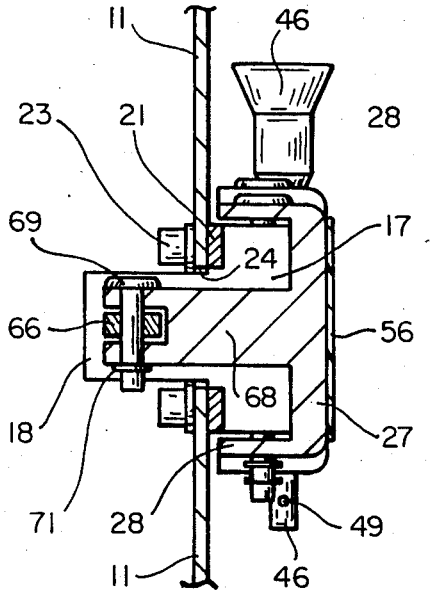
FIG. 2 is a transverse sectional view taken along line 2—2 in FIG. 1.

In the drawings, the invention is illustrated in connection with a panel 11 and an explosive transfer line 12. The panel can, for example, be the side panel of an aircraft canopy frame, and the transfer line can be connected to a linear explosive charge (not shown) for jettisoning the canopy when detonated or fired. The transfer line has an end fitting 13 which contains a percussively fired primer, and the detonation from the primer charge is transferred to the linear charge by the transfer line. In applications such as a canopy jettisoning system, it is important that the transfer line remain intact when the primer is fired, and this line can, for example, be of the type disclosed in U.S. Pat. No. 3,590,739. That line comprises a hollow tube having a coating of pyrotechnic material on the inner wall thereof. When ignited, the pyrotechnic material propagates a gas pressure wave at a velocity on the order of 1,500–2,000 meters per second without rupturing the line. It should be understood that this particular application of the invention is only exemplary and that the invention can be employed in a number of other applications and with different types of primers and transfer lines.

The initiator has a solid, longitudinally extending body 16 having a relatively flat front section 17 of generally rectangular cross-section and a rear section 18 of generally square cross-section. Mounting lugs 21 project longitudinally from the ends of the front body section, and the body is affixed to panel 11 by mounting screws 22 which pass through these lugs and engage nut plates 23 on the back side of the panel. The rear side of the front body section rests against the front side of the panel, and the rear body section projects through a generally rectangular opening 24 in the panel.

Figure 3:
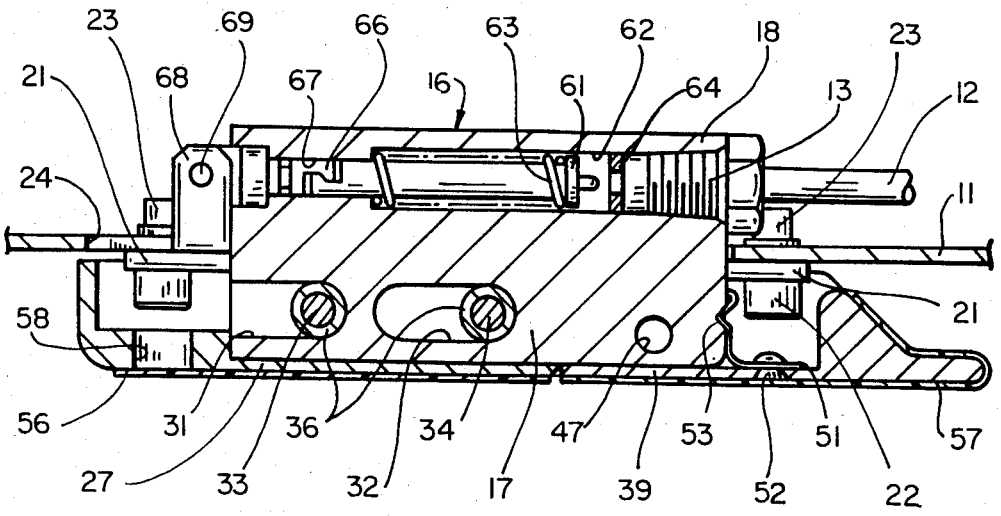
FIG. 3 is a longitudinal sectional view taken along line 3—3 in FIG. 1.
Figure 4:
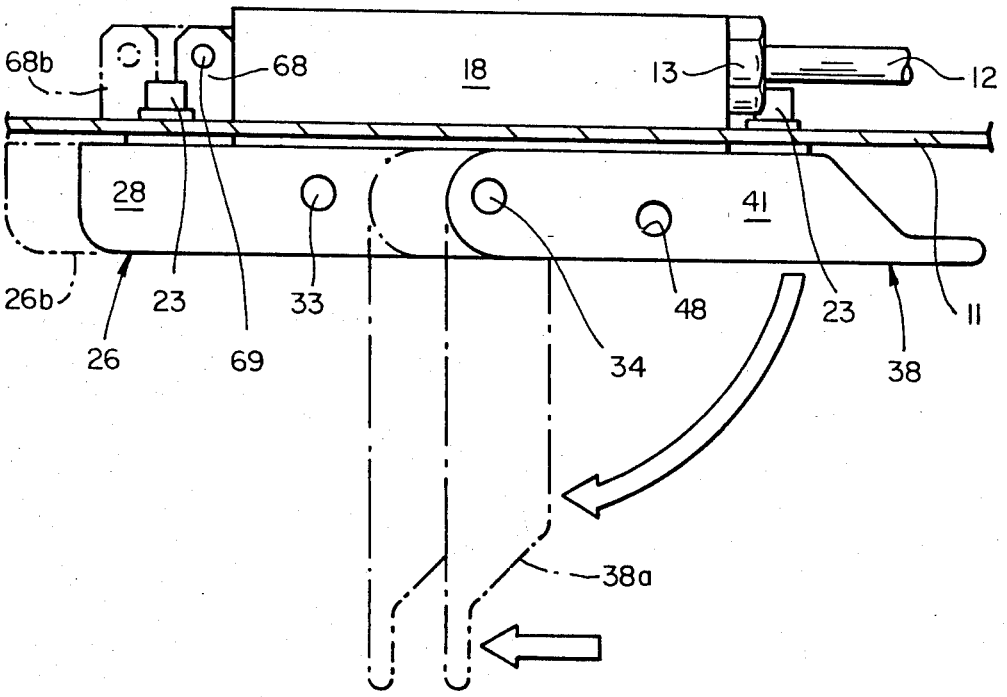
FIG. 4 is a top plan view illustrating the operation of the embodiment of FIG. 1.

A slide 26 is mounted on body 16 for movement in the longitudinal direction between a rest position and a firing position. The slide is shown in the rest position in solid lines in FIGS. 3 and 4, and it is shown in the firing position in broken lines in FIG. 4. The slide has a generally U-shaped transverse section, with a front wall 27 and side flanges 28 which embrace the front section of body 16.

The slide is mounted on the body for rolling movement between the rest position and the firing position. The front section of body 16 has a pair of longitudinally elongated, transversely extending slots 31, 32, and pins 33, 34 extend transversely through these slots between the side flanges of the slide. Roller bearings 36 are mounted on the pins within the slots, and the pins are retained in the slide by clips 37. The width of the slots is slightly greater than the outer diameter of the roller bearings, and the bearings can roll freely in the slots. The length of the slots corresponds to the amount of travel between the rest and firing positions.

An operating handle 38 is pivotally connected to slide 26 by pin 34 for movement between a safe position and an armed position. The handle has a generally U-shaped cross-section, with a front wall 39 and side flanges 41. The side flanges extend longitudinally beyond the front wall of the handle and embrace the side flanges 28 of the slide. Pivot pin 34 passes through the projecting portions of slide flanges 41.

In the safe position, handle 38 extends in the longitudinal direction, with the back side of front wall 39 facing the front surface of body section 17 and side flanges 41 embracing the front body section. In the armed position, which is shown in broken lines in FIG. 4, the handle extends transversely, with the cut-away edge 42 of front wall 39 abutting against the outer surface of front wall 27 and the handle generally perpendicular to the slide. In the rest position, the front walls of the slide and the handle lie in a common plane parallel to panel 11.

A removable safety pin 46 secures the operating handle in its safe position. This pin passes through a transverse bore 47 in body 16 and aligned openings 48 in side flanges 41. The pin has retractable detent balls 49 which project radially from it to retain the pin in its locking position.

Means is also provided for yieldably retaining the handle in its safe position when the safety pin has been removed. This means comprises a resilient latch clip 51 which is secured to the front wall of the handle by rivets 52 and engages a transversely extending detent groove 53 formed in one end of body 16. When the latch clip is engaged with the body, the slide is locked in the rest position.

Plastic overlays 56, 57 are bonded to the front surfaces of slide 26 and handle 38. Instructions for operating the initiator can be printed on this overlay, and the overlay also serves to cover access holes 58 for mounting screws 22.

Means is provided for firing the primer charge in fitting 13 when slide 26 is moved to the firing position. This means includes a firing pin 61 mounted in a longitudinally extending bore 62 in the rear section of body 16. End fitting 13 is threadedly mounted in the body at one end of this bore, and a spring 63 urges the firing pin toward this end of the bore. The travel of the firing pin is limited by a stop 64.

The firing pin is connected to the slide by a sear 66 which is normally received in a bore 67. A clevis 68 extends rearwardly from slide 26 through opening 24, and the sear is connected to the clevis by a pin 69. The pin is retained in the clevis by a resilient clip 71.

Operation and use of the initiator, and therein the method of the invention, are as follows. As long as safety pin 46 is installed, handle 38 is locked in the safe position, and slide 26 cannot move toward the firing position. When the initiator is installed in an aircraft, the safety pin is removed prior to take-off. Thereafter, a two-step movement of handle 38 is required to initiate the primer charge. To arm the initiator, the handle is swung to the position illustrated by broken line **38*a* in FIG. 4. With the handle in the armed position, the primer can be fired by pushing the handle in the longitudinal direction to the position illustrated by broken line 38*b* in FIG. 4. This movement of the handle moves the slide from its rest position to the firing position illustrated by broken lines 26*b*, 68*b* in FIG. 4. As the slide moves, it draws the firing pin away from the primer charge, compressing spring 63. This cocking action continues until the sear is pulled out of bore 67**, at which point the sear releases the firing pin to impact upon and detonate the primer charge.

While the invention has been illustrated with specific reference to a percussion primer, it can be employed with other types of primers, for example, a stab initiator or an electrically initiated primer. With an electrically fired primer, the firing pin would, of course, be replaced with electrical contacts.

It is apparent from the foregoing that a new and improved explosive initiator and method have been provided. While only certain presently preferred embodiments have been described in detail, as will be apparent to those familiar with the art, certain changes and modifications can be made without departing from the scope of the invention as defined by the following claims.

We claim:

1. In an initiator for an explosive charge: a body, a slide mounted on the body for movement between a rest position and a firing position, firing means connected to the slide for initiating the charge when the slide is in the firing position, and a handle pivotally connected to the slide for movement between a safe position in which the handle extends in a longitudinal direction and holds the slide in the rest position and an armed position in which the handle extends in a transverse direction and can be pushed in the longitudinal direction to move the slide to the firing position.

2. The initiator of claim 1 wherein the charge is percussively fired, and the firing means includes a firing pin, means yieldably urging the firing pin toward the charge, and sear means connecting the firing pin to the slide for drawing the firing pin away from the charge as the slide is moved toward the firing position and releasing the firing pin when the slide reaches the firing position. to the firing position.

3. The initiator of claim 1 including rollers mounting the slide on the body for rolling movement between the rest position and the firing position.

4. The initiator of claim 3 wherein the rollers are carried by the slide and received in longitudinally extended slotted openings in the body.

5. The initiator of claim 1 including a removable safety pin passing transversely of the body and securing the handle in the safe position.

6. The initiator of claim 5 including a latch which yieldably retains the handle in the safe position when the safety pin has been removed.

7. In an initiator for an explosive charge: a longitudinally extending, relatively flat body adapted to be mounted on a surface and having a pair of longitudinally elongated slotted openings formed therein, a slide mounted on the body and having a pair of transverse pins extending through the slotted openings with rollers carried by the pins positioned within the openings and adapting the slide for rolling movement between a rest position and a firing position, a handle pivotally mounted on one of the transverse pins for movement between a safe position in which the handle extends longitudinally of the body and holds the slide in the rest position and an armed position in which the handle is perpendicular to the body and can be pushed longitudinally of the body to move the slide from the rest position to the firing position, and firing means for initiating the charge when the slide is moved to the firing position.

8. The initiator of claim 7 wherein the handle has a generally U-shaped transverse cross-section with side flanges which embrace the body when the handle is in the safe position.

9. The initiator of claim 7 including a removable safety pin which extends through aligned openings in the side flanges of the handle and a transverse bore in the body to secure the handle in the safe position.

10. The initiator of claim 7 including a latch member carried by the handle and engageable with the body to retain the handle in the safe position.

11. The initiator of claim 7 wherein the firing means includes a firing pin axially movable in a longitudinally extending bore in the body, a spring which urges the firing pin toward the charge, and sear means interconnecting the firing pin and the slide for drawing the firing pin away from the charge as the slide is moved toward the firing position and releasing the firing pin to be driven against the charge by the spring when the slide reaches the firing position.

12. The initiator of claim 11 wherein the bore for the firing pin is formed in a portion of the body which projects rearwardly from the main portion of the body and is received in an opening in the surface on which the body is mounted.

13. The initiator of claim 12 wherein the charge is carried by a fitting threadedly mounted in the bore at one end of the body.

14. In a method of firing an explosive charge with an initiator having a slide movable longitudinally between a rest position and a firing position, a pivotally mounted handle operatively connected to the slide, and a firing mechanism actuated by the slide to the firing position, the steps of: releasably latching the handle in a safe position in which the handle extends longitudinally and holds the slide in the rest position, swinging the handle from the safe position to an armed position in which the handle extends transversely, and moving the handle longitudinally in the armed position to move the slide to the firing position and thereby actuate the firing mechanism to initiate the charge.

15. The method of claim 14 including the steps of securing the handle in the safe position with a safety pin, and removing the safety pin to permit movement of the handle to the armed position.

* * * * *